US005238011A

United States Patent [19]

Gueret

[11] Patent Number: 5,238,011

[45] Date of Patent: Aug. 24, 1993

[54] BRUSH FOR THE APPLICATION OF A MAKE-UP PRODUCT

[75] Inventor: Jean-Louis H. Gueret, Parix, France

[73] Assignee: L'Oreal, Paris, France

[21] Appl. No.: 844,172

[22] Filed: Mar. 2, 1992

[30] Foreign Application Priority Data

Apr. 16, 1991 [FR] France ..... 91 04619

[51] Int. Cl.[5] ..... A45D 40/26

[52] U.S. Cl. ..... 132/218; 132/320; 15/159.1

[58] Field of Search ..... 132/216, 218, 313, 320; 15/159.1, 167.1, 167.3, 206

[56] References Cited

U.S. PATENT DOCUMENTS

| | | | |
|---|---|---|---|
| 3,186,018 | 6/1965 | Shaw | 15/159.1 |
| 4,403,624 | 9/1983 | Montgomery | 132/218 |
| 4,463,485 | 8/1984 | Gueret | 128/67 |
| 4,586,520 | 5/1986 | Brittain | 132/218 |
| 4,733,425 | 3/1988 | Hartel et al. | 132/218 |
| 4,861,179 | 8/1989 | Schrepf et al. | 132/218 |
| 4,898,193 | 2/1990 | Gueret | 132/218 |

FOREIGN PATENT DOCUMENTS

| | | |
|---|---|---|
| 0038524 | 1/1981 | Europeaf Pat. Off. . |
| 0329505 | 8/1989 | European Pat. Off. . |
| 1183937 | 2/1959 | France . |
| 2038957 | 1/1971 | France . |
| 2506578 | 12/1982 | France . |

*Primary Examiner*—Gene Mancene
*Assistant Examiner*—Frank A. LaViola
*Attorney, Agent, or Firm*—Cushman, Darby & Cushman

[57] ABSTRACT

The brush (1) comprises a plurality of bristles (2) wedged in the turns of at least two spiral branches (3, 4) of metal wire forming the core (5) of the brush, the bristles being arranged substantially radially. The brush comprises bristles (2) made of a soft material having a Shore hardness of between 20 A and 40 D. Their diameter is sufficiently large to prevent them having too high a degree of suppleness.

17 Claims, 1 Drawing Sheet

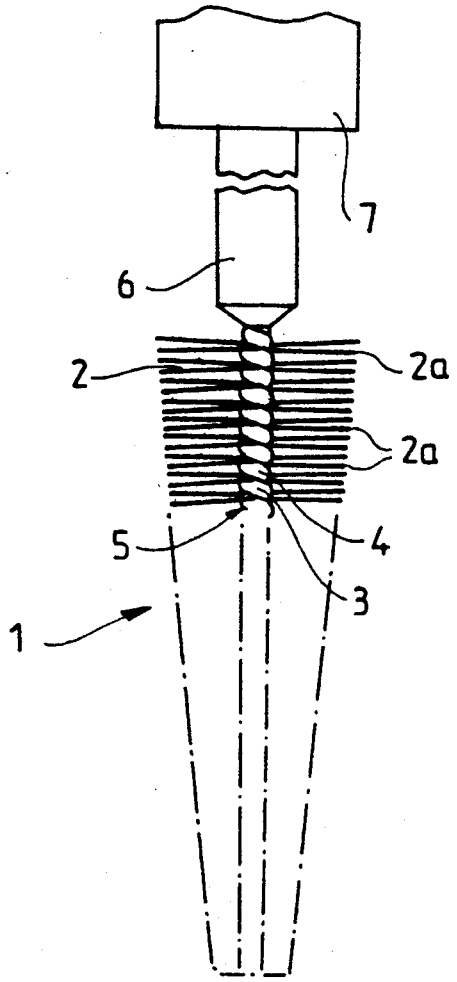
FIG. 1
FIG. 2
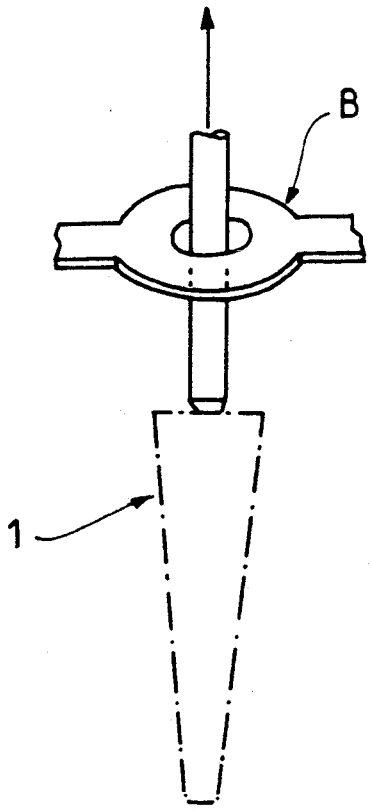
FIG. 3a
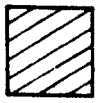
FIG. 3b
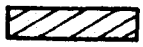
FIG. 3c
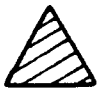
FIG. 3d
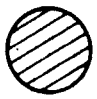
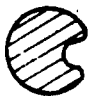
FIG. 3e

BRUSH FOR THE APPLICATION OF A MAKE-UP PRODUCT

FIELD OF THE INVENTION

The invention relates to a brush for the application of a make-up product, especially for the application of mascara to the eyelashes or of dye to the hair, of the type comprising a plurality of bristles wedged in the turns of at least two spiral branches of metal wire forming the core of the brush, the bristles being arranged substantially radially.

The bristles used for brushes of this kind must be selected in such a manner that the brush does not cause too much irritation for sensitive eyes. However, the brush must also be capable of depositing a sufficient quantity of the make-up product, especially on the eyelashes.

BACKGROUND OF THE INVENTION

The material used at present for the bristles of brushes of the type defined hereinbefore generally consists of a polyamide. If it is desired to obtain a "soft" brush, not causing irritation for sensitive eyes, it is necessary to use bristles of a small diameter, e.g. 6 hundredths of a millimeter, so that the bristles display great suppleness. However, this results in the disadvantage, on the one hand, that a small bristle diameter of this kind will mean a wide turn along the entire length of the brush and, on the other hand, that it deposits very little product on the eyelashes. The space between each strand of small diameter is small and the make-up effect obtained with a brush of this kind is very natural, whereas, in most cases, it is desired to obtain a specific make-up effect.

SUMMARY OF THE INVENTION

The object of the invention is above all to provide a brush which no longer has, or displays to a lesser extent, the disadvantages mentioned hereinabove. The object of the invention is in particular to provide a brush at least as soft as that obtained with bristles of polyamide having a diameter of 6 hundredths of a millimeter and by means of which the eyelashes can be made up heavily, while still having very soft and non-irritating contact with the eye, and ensuring very clear separation of the eyelashes.

According to the invention, a brush for the application of a make-up product of the type defined hereinbefore is characterised in that it comprises bristles made of a soft material having a Shore hardness of between 20 A and 40 D and that the diameter of these bristles is sufficient to prevent them having too high a degree of suppleness.

According to a first possibility, all of the bristles of the brush are made of a soft material having a Shore hardness of between 20 A and 40 D, with a sufficient diameter to prevent too high a degree of suppleness.

According to another possibility, the bristles of soft material are mixed with other bristles made of different materials, especially polyamide or polyester, and having substantially the same rigidity as the bristles of soft material. The proportion of bristles of soft material in terms of number is preferably at least 40% of the total number of bristles of the brush. E.g. the brush will comprise 50% of bristles of soft elastomeric material having a circular section with a diameter of 30 hundredths of a millimeter and 50% of bristles of polyamide having a circular section with a diameter of 8 hundredths or 10 hundredths of a millimeter.

The use of soft bristles for brushes was avoided in practice, as it was acknowledged that the product could not be spread properly with soft bristles of this kind as a result of their great suppleness. The invention has overcome this prejudice and by virtue of soft bristle diameters greater than those of the conventional bristles of polyamide, it has been possible to establish that the brushes produced in this manner make it possible to obtain make-up applied in the desired quantity, while still displaying greater softness than conventional brushes with bristles of polyamide.

In addition, in a surprising and advantageous manner, when the brush is twisted with a minimum torque, in the case of soft bristles of large diameter of the invention, a "jumbled" bristle appearance is obtained as a result of the deformation of their diameter when they are slightly twisted. The turn effect at the ends of the soft bristles disappears and the tufting is more homogeneous than with bristles of polyamide.

The charging space is more regular. As a result of the large diameter of the soft bristles, the number of bristles per turn of the core is reduced, so that the space between the bristles is larger, thereby making it possible to obtain a greater charge at each bristle.

The brush preferably comprises 8 to 40 bristles per turn.

The soft bristles are advantageously made of elastomeric or thermoplastic material.

The material is preferably selected from the following group of materials: silicone, EVA=ethylene vinyl acetate copolymer, polyether amide block copolymer, polyester elastomer, EPDM=ethylene propylene diene monomer rubber, polyurethane, SBS=styrene butadiene styrene, latex and nitrile butadiene rubber.

The diameter of the soft bristles is preferably between 10 and 35 hundredths of a millimeter.

The metal wire forming the branches of the core is advantageously a soft iron wire allowing for slight elongation, so as to avoid cutting the bristles during twisting. The diameter of the iron wire may be between 0.4 and 0.9 mm.

The bristles are preferably solid. They may have a square, flat rectangular, triangular or cylindrical section. The cylindrical bristles may be hollow. The bristles may comprise at least one capillary groove.

In addition to the arrangements described hereinabove, the invention consists of a number of other arrangements which will be described in more detail hereinafter by way of one particular non-limiting embodiment described with reference to the accompanying drawings, in which:

BRIEF DESCRIPTION OF THE DRAWINGS

FIG. 1 is a diagrammatic elevation of a brush according to the invention, with broken-away portions;

FIG. 2 is a rough illustration of a means of testing the hardness of the brush, and FIGS. 3*a* to 3*e* show various possible sections for the bristles on a larger scale.

DETAILED DESCRIPTION OF THE INVENTION

Referring to FIG. 1 of the drawings, it shows a brush 1 for the application of a make-up product having a liquid to pasty consistency, especially mascara.

The brush comprises a plurality of bristles 2 wedged in the turns of two twisted branches 2, 4 of metal wire forming the core 5 of the brush. The core 5 is integral with a rod 6 provided at its end remote from the bristles 2 with a cap 7 for manipulation of the brush.

The bristles 2 are arranged substantially radially and are wedged between the turns approximately in their central portion. As a variant, the bristles can be eccentric relative to the core 5.

The bristles 2 are made of a soft material having a Shore hardness of between 20 A and 40 D. The material of the bristles is advantageously an elastomeric or thermoplastic material.

The material used for the bristles 2 is advantageously selected from the following group of materials: silicone, EVA=ethylene vinyl acetate copolymer, polyether amide block polymer, polyester elastomer, EPDM=ethylene propylene diene monomer rubber, polyurethane, SBS=styrene butadiene styrene, latex and nitrile butadiene rubber.

The diameter of the bristles is sufficient to prevent them having too high a degree of suppleness. This diameter is advantageously between 10 and 35 hundredths of a millimeter, and preferably between 15 and 30 hundredths of a millimeter.

The bristles 2 have a solid section, especially a square section (FIG. 3*a*), a flat rectangular section (FIG. 3*b*), a triangular section (FIG. 3*c*), a circular section (FIG. 3*d*) or a hollow circular section. The bristles can be used alone or mixed.

The bristles may comprise at least one capillary groove (FIG. 3*e*).

The metal wire forming the branches 3, 4 of the core is advantageously a soft iron wire allowing for slight elongation, so as to reduce the risk of the bristles 2 being cut during twisting. The diameter of the iron wire forming the branches 3, 4 is advantageously between 0.4 and 0.9 mm.

An example of an advantageous metal wire for forming the core of the brush is the monel type wire made of a soft stainless steel alloy.

As a result of the fact that the bristles 2 are made of a soft material and have a relatively large diameter, when the branches 3, 4 are twisted with a minimum torque so as to wedge the bristles, the latter, as a result of the deformation of their diameter, take on a "jumbled" appearance, i.e. two immediately adjacent bristles are inclined in a different manner. Sufficient twisting gives a generally homogeneous tuft, in which the ends 2*a* of the bristles are substantially equidistant from one another and are distributed regularly along the entire length of the brush. The turn effect of the twisted core is lost in this manner. The charging spaces between the bristles 2 are distributed more regularly over the entire volume occupied by the brush.

By virtue of the bristles of soft material, preferably of elastomeric material, it is possible to obtain deformation in two directions, either compression deformation or expansion deformation.

When bristles comprising at least one capillary groove are used, the phenomenon of relatively regular dispersion of the ends of the bristles along the entire length of the brush can be accentuated to an even greater extent.

As a result of the relatively large diameter of the bristles, the brush only comprises approximately eight to forty bristles per turn, so that the spaces between the bristles are greater than in the case of bristles of larger diameter more numerous per turn. Each bristle is charged to a greater extent with product.

When the brush is wiped by means of a wiper means (in the shape of a ring) of small internal diameter, the bristles 2 of soft material lie down and are therefore wiped to a lesser extent. When making up, the "comb" formed by the bristles of the brush, although less effective for spreading the product over the eyelashes than in the case of a brush having harder bristles, makes it possible to compensate for this negative factor as a result of the fact that the charge of product is greater.

Consequently, the brush allows for efficient making-up with the advantage of great softness and a reduction of the risk to the eyes as the bristles are soft. A brush of this kind can be used to apply a second coat of make-up to an eye already made-up, without affecting the first make-up application, this being advantageous, e.g. for applying a glossy product to make-up.

The use of a product of this kind is relatively independent of the fluidity of the product to be distributed.

The selection of the number of bristles, the diameter of the bristles, their section and their distribution before twisting, the selection of the diameter of the iron wire forming the branches of the core and the torsional torque applied to these branches to produce the brush make it possible to obtain brushes having non-uniform softness, the sliding of which will ensure the lightest to the heaviest make-up effect.

The following tests were carried out in order to demonstrate the suppleness of the bristles of the brushes according to the invention compared to conventional brushes with bristles of polyamide.

Brushes made with the different types of bristles and having identical or similar shapes and dimensions were drawn through a ring B held fixed, shown in FIG. 2, the diameter of the opening of which was less than the outer diameter of the brush. The tractive force that had to be applied to the brush to make it pass through the ring was measured.

A brush formed with bristles of elastomeric material having a diameter of 20 hundredths of a millimeter required a tractive force through the ring B characterised by a value equal to 0.06 Newtons.

For the same shape of brush, with bristles of polyamide having a diameter of 8 hundredths of a millimeter, the tractive force for passage through the ring B was greater, corresponding to a value equal to 0.32 Newtons.

Finally, for a brush having the same shape, but made with bristles of polyamide having a diameter of 10 hundredths of a millimeter, the tractive force required to make the brush pass through the ring B corresponded to a value equal to 0.48 Newtons, i.e. eight times greater than that required for a brush made with bristles of soft material and having twice as large a diameter.

In the embodiment described hitherto, all of the bristles of the brush are soft bristles.

As a variant, the brush may comprise soft bristles mixed with other bristles made of different materials, e.g. polyamide or polyester, and having substantially the same rigidity (and therefore substantially the same suppleness) as the soft bristles. The proportion of bristles of soft material in terms of number is preferably at least 40% of the total number of bristles of the brush. E.g. the brush may comprise 50% of bristles of elastomeric material having a circular section with a diameter of 30 hundredths of a millimeter and 50% of bristles of polyamide having a circular section with a diameter of 8 hundredths or 10 hundredths of a millimeter.

A brush according to the invention has numerous advantages.

It does not cause irritation, especially for sensitive eyes.

It it possible to wipe off excess product to a lesser extent when using liquid formulations.

It is possible not to remove a make-up product already applied to the eyelashes when applying a conditioner during a second making-up operation.

It displays very homogeneous distribution of the ends 2*a* of the bristles along the entire length of the brush.

It makes it possible to apply thick formulations without affecting the application to the eyelashes.

For a brush of this kind, it is possible to use a central or eccentric core. It is also possible to use brushes having, e.g. a triangular, hexagonal section, etc.. The ends of the bristles can be milled.

The softness of a brush according to the invention means that the hardness following wiping will no longer be experienced.

I claim:

1. A brush for the application of a make-up product, especially for the application of mascara to the eyelashes or a dye to the hair, comprising a plurality of first bristles and a plurality of second bristles held in the turns of at least two spiral branches of metal wire forming a core of the brush, said bristles being arranged substantially radially, said first bristles being a soft material having a Shore hardness of between 20 A and 40 D and having a diameter that is sufficiently large to prevent said first bristles from having too high a degree of suppleness, said first bristles being made of a selected material and said second bristles being made of a different material and having substantially the same rigidity as said first bristles, said different material being one of polyamide and polyester.

2. Brush according to claim 1 wherein the proportion of said first bristles of soft material in terms of number is at least 40% of the total number of bristles of the brush.

3. Brush according to claim 1 wherein, the bristles of soft material are made of elastomeric or thermoplastic material.

4. Brush according to claim 3, wherein said first bristles (2) of soft material are made of a material selected from the group of materials including one of silicone, ethylene vinyl acetate copolymer, polyether amide block polymer, polyester elastomer, ethylene propylene diene monomer rubber, polyurethane, styrene butadiene styrene, latex and nitrile butadiene rubber.

5. Brush according to claim 1 wherein the diameter of the bristles of soft material is between 10 and 35 hundredths of a millimeter.

6. Brush according to claim 1 wherein said first bristles of soft material have at least one capillary groove.

7. Brush according to claim 1 wherein said wire forming the branches of the core is a soft iron wire allowing for slight elongation, so as to avoid cutting the bristles during twisting.

8. Brush according to claim 1 wherein the diameter of the wire forming the branches of the core is between 0.4 and 0.9 mm.

9. Brush according to claim 1 wherein said brush comprises 8 to 40 bristles per turn.

10. The brush as claimed in claim 1 wherein said first bristles have a solid cross-section.

11. The brush as claimed in claim 1 wherein said first bristles have a square cross-section.

12. The brush as claimed in claim 1 wherein said first bristles have a flat rectangular cross-section.

13. The brush as claimed in claim 1 wherein said first bristles have a triangular cross-section.

14. The brush as claimed in claim 1 wherein said first bristles have a circular cross-section.

15. The brush as claimed in claim 1 wherein said first bristles have a hollow circular cross-section.

16. A brush for the application of a make-up product, especially for the application of mascara to the eyelashes or a dye to the hair, comprising a pluraity of first bristles and a plurality of second bristles held in the turns of at least two spiral branches of metal wire forming a core of the brush, said bristles being arranged substantially radially, said first bristles being a soft material having a Shore hardness of between 20 A and 40 D and having a diameter that is sufficiently large to prevent said first bristles from having too high a degree of suppleness, said first bristles being made of a selected material and said second bristles being made of a different material and having substantially the same rigidity as said first bristles, said different material being one of polyamide and polyester, the proportion of said first bristles of soft material in terms of number is to at least 40% of the total number of bristles of the brush, said first bristles being made of one of an elastomeric and thermoplastic material.

17. A brush for the application of a make-up product, especially for the application of mascara to the eyelashes or a dye to the hair, comprising a plurality of bristles held in the turns of at least two spiral branches of metal wire forming a core of the brush, said bristles being arranged substantially radially, said bristles being a soft material having a Shore hardness of between 20 A and 40 D and having a diameter that is sufficiently large to prevent said bristles from having too high a degree of suppleness, said bristles being made of one of an elastomeric and thermoplastic material selected from the group comprising one of silicone, ethylene binyl acetate copolymer, polyether amide block polymer, polyester elastomer, ethylene propylene diene monomer rubber, polyurethane, styrene butadiene, latex and nitrile butadiene rubber, said diameter of said bristles being between 10 and 35 hundredths of a millimeter.

* * * * *